US010184746B1

(12) United States Patent
Liu

(10) Patent No.: US 10,184,746 B1
(45) Date of Patent: Jan. 22, 2019

(54) BIPOD DUAL-MOUNT ATTACHMENT STRUCTURE

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/039,580

(22) Filed: Jul. 19, 2018

(51) Int. Cl.
*F41A 23/08* (2006.01)
*F41A 23/10* (2006.01)

(52) U.S. Cl.
CPC ..... *F41A 23/10* (2013.01)

(58) Field of Classification Search
CPC ..... F41A 23/10; F41A 23/08
USPC ..... 42/94
See application file for complete search history.

(56) References Cited

U.S. PATENT DOCUMENTS 8,104,213 B2 * 1/2012 Keng ..... F41A 23/10 42/94
8,402,684 B1 * 3/2013 Beltz ..... F41A 23/10 42/72
8,904,693 B1 * 12/2014 Beltz ..... F41A 23/10 42/72
9,303,940 B2 * 4/2016 Bonelli ..... F16M 11/14
2014/0115940 A1 * 5/2014 Bonelli ..... F16M 11/14 42/94
2015/0362278 A1 * 12/2015 Genchel ..... F41A 23/10 42/94
2018/0259287 A1 * 9/2018 Palu ..... F41A 23/10

* cited by examiner

*Primary Examiner* — Reginald S Tillman, Jr.
(74) *Attorney, Agent, or Firm* — Jackson IPG PLLC; Demian K. Jackson

(57) ABSTRACT

A bipod dual-mount attachment structure consisting of a leg attachment base, an axle housing, an attachment base, a pivot shaft, a saddle base, a lift control screw, an adjustment knob, a male swivel stud clamp and a female swivel stud clamp. When rotating the adjustment knob clockwise or counter-clockwise, the lift control screw is moved upward or downward to extend out the male and female swivel stud clamps for securing a gun that is equipped with a swivel stud, or to receive the male and female swivel stud clamps for securing a gun that is equipped with a rail, achieving dual use.

3 Claims, 9 Drawing Sheets

BIPOD DUAL-MOUNT ATTACHMENT STRUCTURE

BACKGROUND AND SUMMARY OF THE INVENTION

The present invention relates to hunting gear and more specifically, to a bipod dual-mount attachment structure, which is practical for securing and supporting a gun that is equipped with a swivel stud as well as a gun that is equipped with a rail.

Commercial bipods have two types respectively designed for securing and supporting a gun that is equipped with a swivel stud, or a gun that is equipped with a rail. However, a hunter may carry two different types of guns. In order to support two different types of guns, the user needs to prepare two different types of bipods, not only waste money, but also increase the inconvenience of carrying and occupying storage space.

The present invention has been accomplished under the circumstances in view. It is therefore the main object of the present invention to provide a bipod dual-mount attachment structure, which allows the user to rotate an adjustment knob in moving a lift control screw upward or downward so as to extend out or receive a male swivel stud clamp and a female swivel stud clamp for securing a gun that is equipped with a swivel stud, or a gun that is equipped with a rail, and thus, the bipod dual-mount attachment structure achieves dual use.

DETAILED DESCRIPTION OF THE INVENTION

Figure 1:
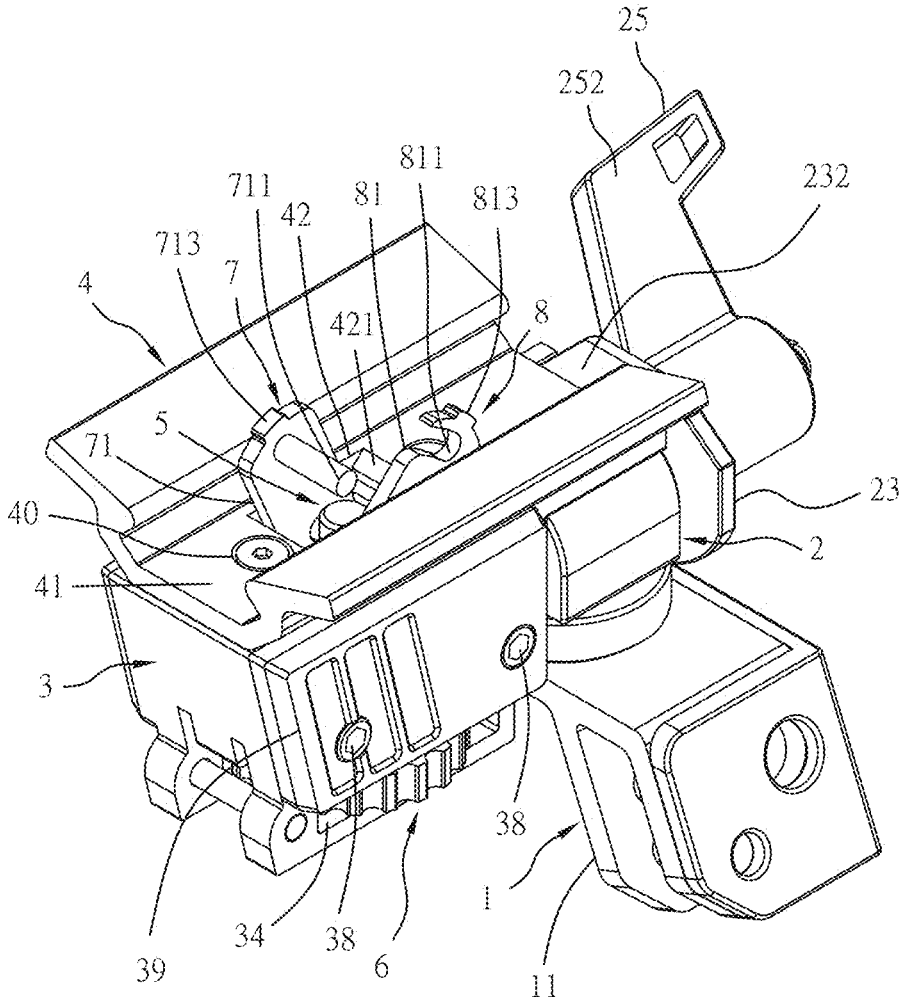
FIG. 1 is an oblique top elevational view of a bipod dual-mount attachment structure in accordance with the present invention.
Figure 2:
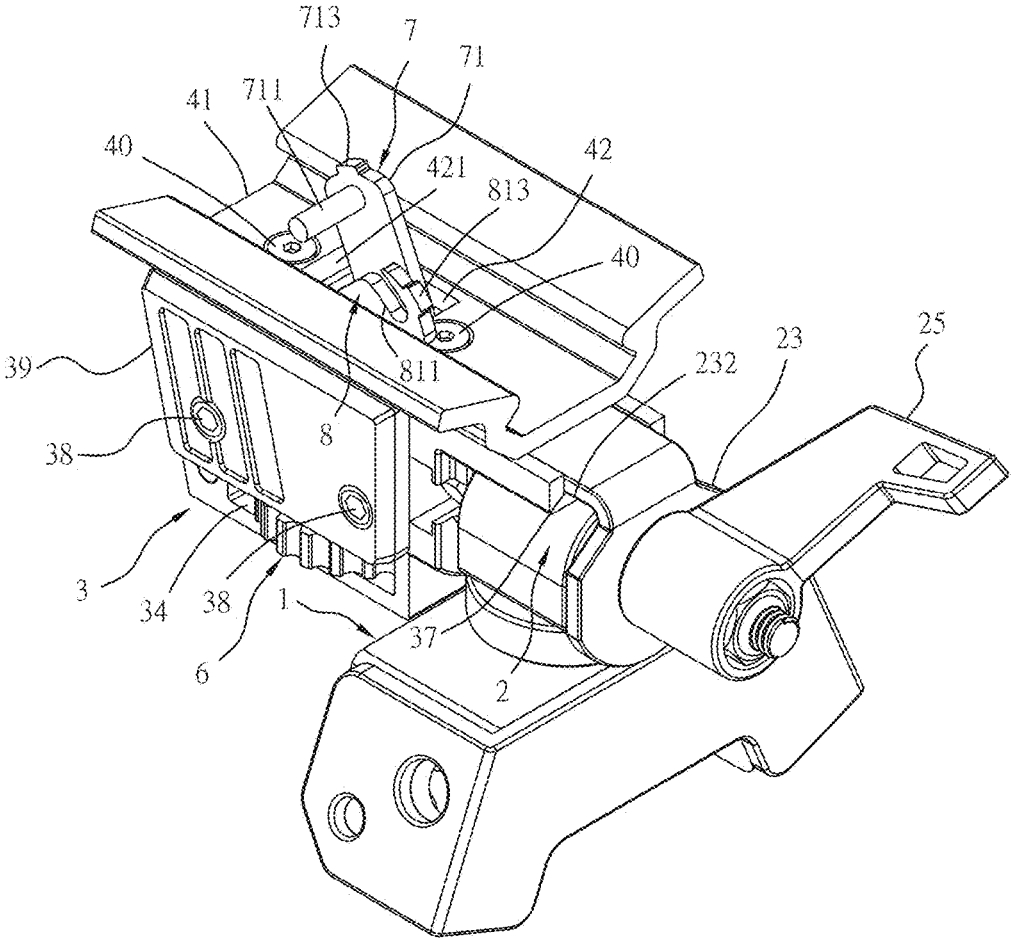
FIG. 2 corresponds to FIG. 1 when viewed from another angle.
Figure 3:
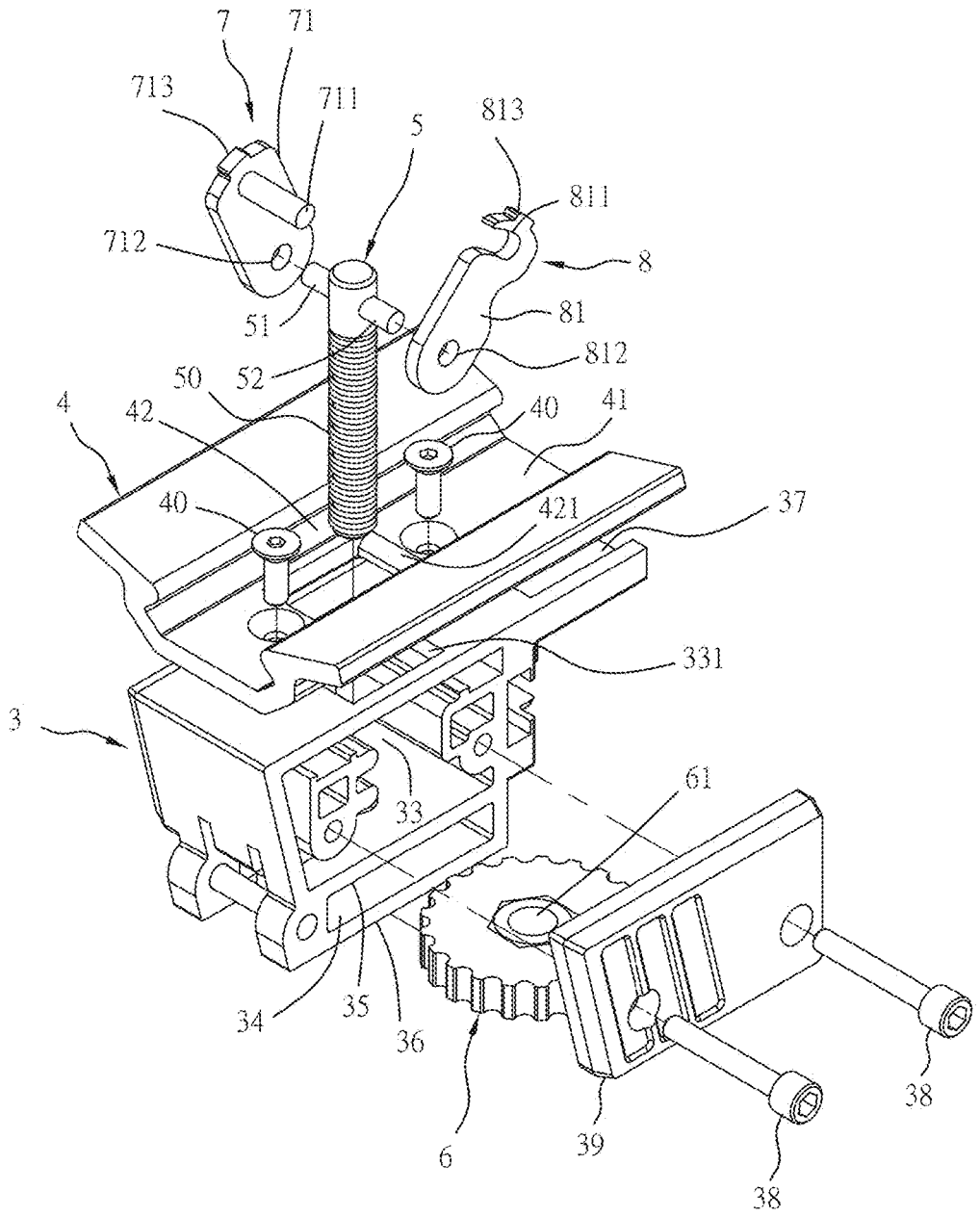
FIG. 3 is an exploded view of the attachment base and saddle base, the lift control screw, the male swivel stud clamp, the female swivel stud clamp, the adjustment knob and the ornamental cover.
Figure 4:
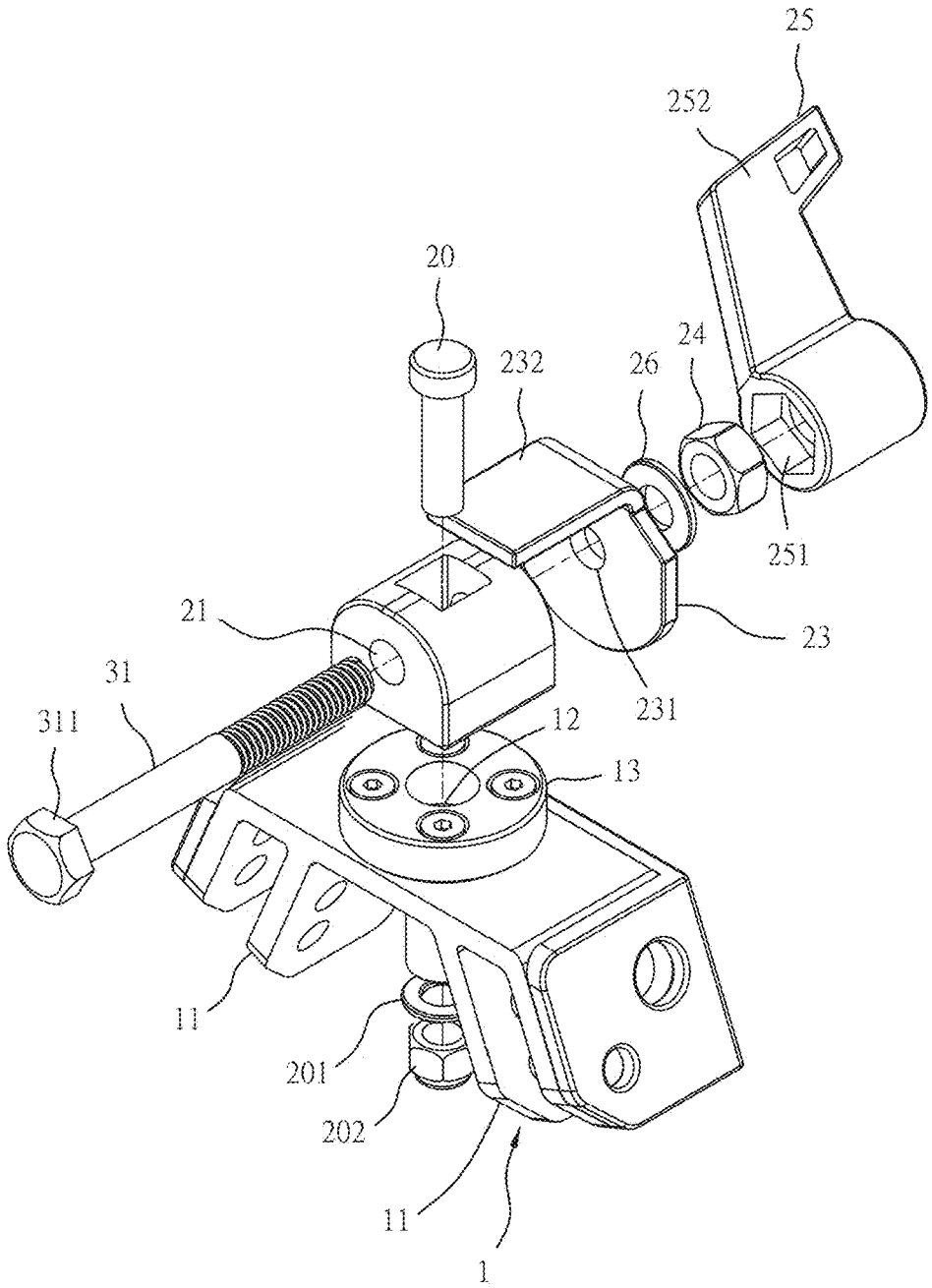
FIG. 4 is an exploded view of the leg attachment base, the axle housing, the pivot shaft, the packing member and the tool.
Figure 5:
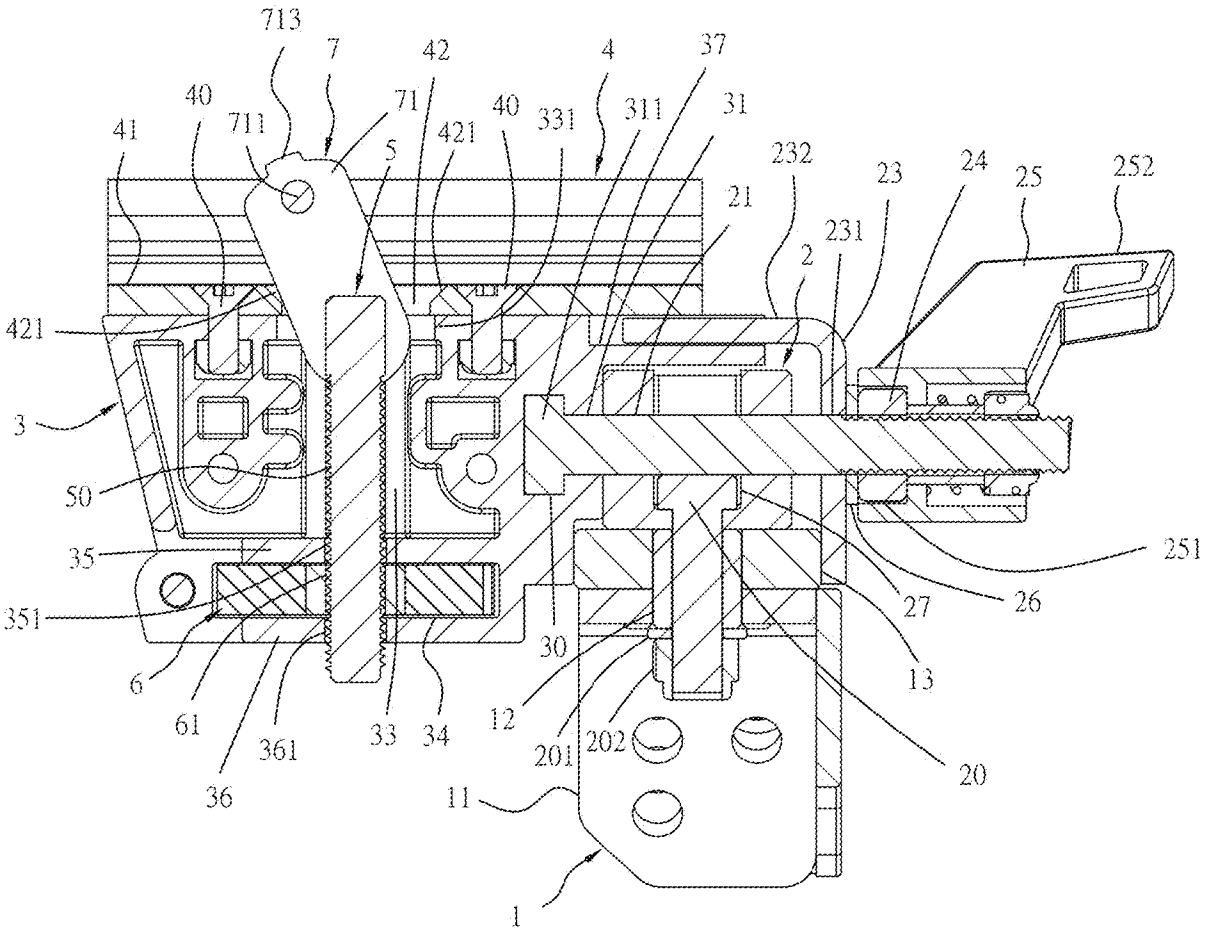
FIG. 5 is a schematic sectional view of the present invention, illustrating the lift control screw lifted.

Referring to FIGS. 1-9, a bipod dual-mount attachment structure in accordance with the present invention is shown. The bipod dual-mount attachment structure comprises:

a leg attachment base 1 comprising two connection portions 11 symmetrically disposed at two opposite lateral sides thereof (see FIGS. 1 and 4) for the connection of a respective leg (not shown) in a pivotable manner and a first pivot connection hole 12 located in the center (see FIG. 4);

an axle housing 2 comprising a second pivot connection hole 27 (see FIG. 5) cut through opposing top and bottom sides thereof and pivotally connected to the first pivot connection hole 12 of the leg attachment base 1 with a first pivot bolt 20, a gasket 201 and a first nut 202 (see FIG. 5) for allowing rotation of the axle housing 2 relative to the leg attachment base 1, and a transverse axle hole 21 cut through opposing front and rear sides thereof;

an attachment base 3 comprising a locating groove 30 located at one side thereof (see FIGS. 5 and 6) for the positioning of one end 311 of a pivot shaft 31, a slideway 37, a top hole 331, an internal constraint hole 33 disposed below and in communication with the top hole 331 (see FIGS. 3, 5 and 6), a lower accommodation chamber 34 spaced below the internal constraint hole 33, an upper through hole 351 cut through a top partition wall 35 of the lower accommodation chamber 34 and a bottom through hole 361 cut through an opposing bottom partition wall 36 of the lower accommodation chamber 34 (see FIG. 5);

a pivot shaft 31 pivotally connecting the attachment base 3 to the transverse axle hole 21 of the axle housing 2, having one end 311 thereof positioned in the locating groove 30 of the attachment base 3;

a saddle base 4 affixed to the top side of the attachment base 3 with first fastening members 40, comprising a transverse sliding groove 41, a guide groove 42 disposed in communication with the transverse sliding groove 41 with a bottom end thereof aimed at the top hole 331 of the attachment base 3 and defining two opposing guide surfaces 421 (see FIGS. 2 and 55);

a lift control screw 5 (see FIGS. 1 and 3) comprising a first pivot rod 51 and a second pivot rod 52 transversely aligned in a line near a top end thereof and a threaded shank 50 (see FIGS. 3 and 5) inserted in proper order through the top hole 331, internal constraint hole 33, upper through hole 351 and bottom through hole 361 of the attachment base 3 (see FIG. 5);

an adjustment knob 6 mounted in the lower accommodation chamber 34 of the attachment base 3, comprising a center screw hole 61 (see FIGS. 3 and 5) threaded onto the threaded shank 50 of the lift control screw 5;

a male swivel stud clamp 7 (see FIGS. 1-3) comprising a male clamp base plate 71, a pin 711 perpendicularly formed integral with a top side of the male clamp base plate 71, a first pivot hole 712 located at an opposing bottom side of the male clamp base plate 71 (see FIGS. 3 and 5) and pivotally coupled to the first pivot rod 51 of the lift control screw 5 and a first engagement block 713 protruded from the top side of the male clamp base plate 71; and a female swivel stud clamp 8 comprising a female clamp base plate 81, an arched positioning notch 811 located at a top side of the female clamp base plate 81, a second pivot hole 812 located at an opposing bottom side of the female clamp base plate 81 (see FIGS. 3 and 6) and pivotally coupled to the second pivot rod 52 of the lift control screw 5 and a second engagement block 813 protruded from the top side of the female clamp base plate 81.

Figure 6:
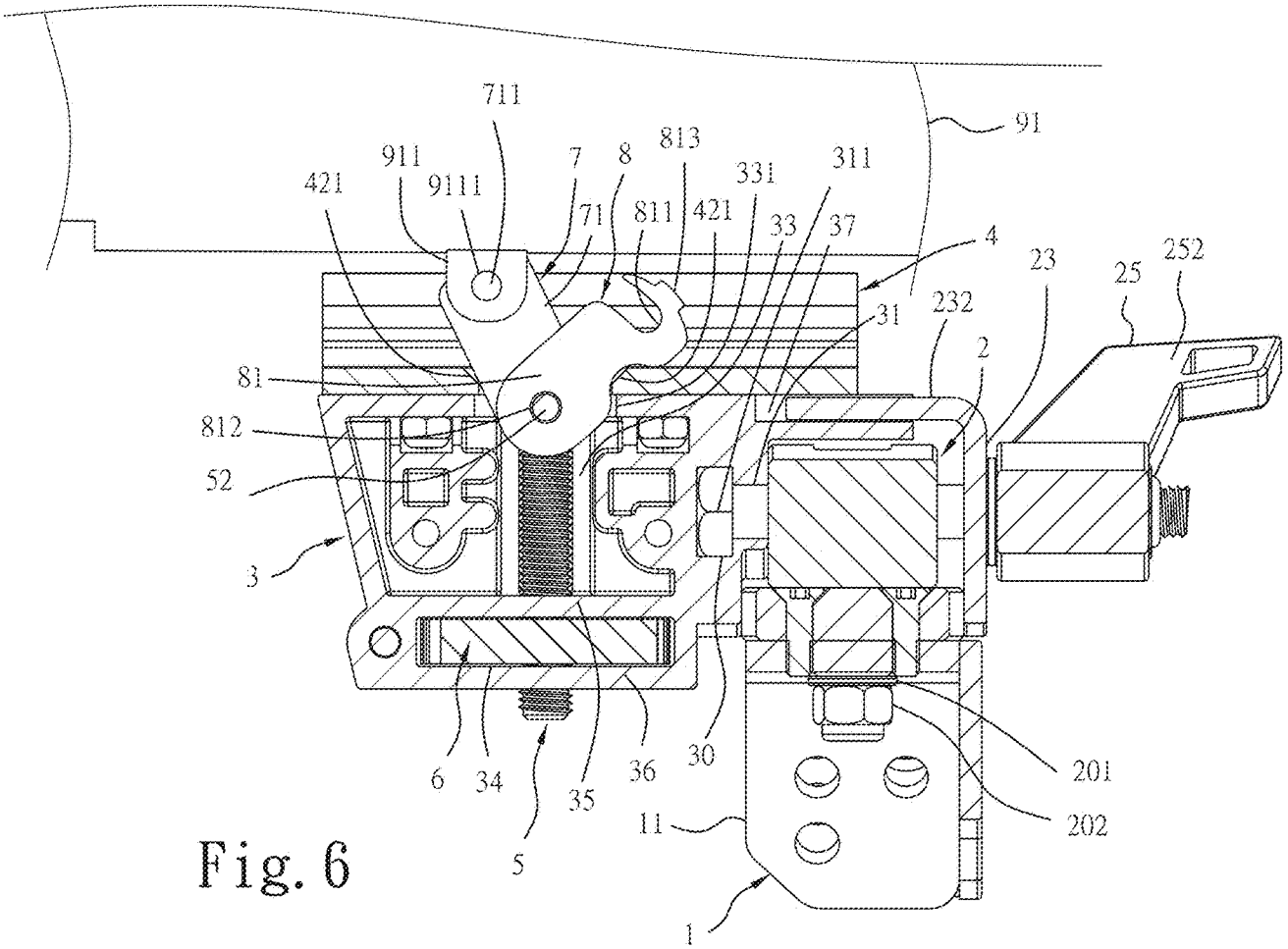
FIG. 6 is a schematic sectional view illustrating the lift control screw lifted, the pin of the male swivel stud clamp fastened to a swivel stud of a gun.
Figure 7:
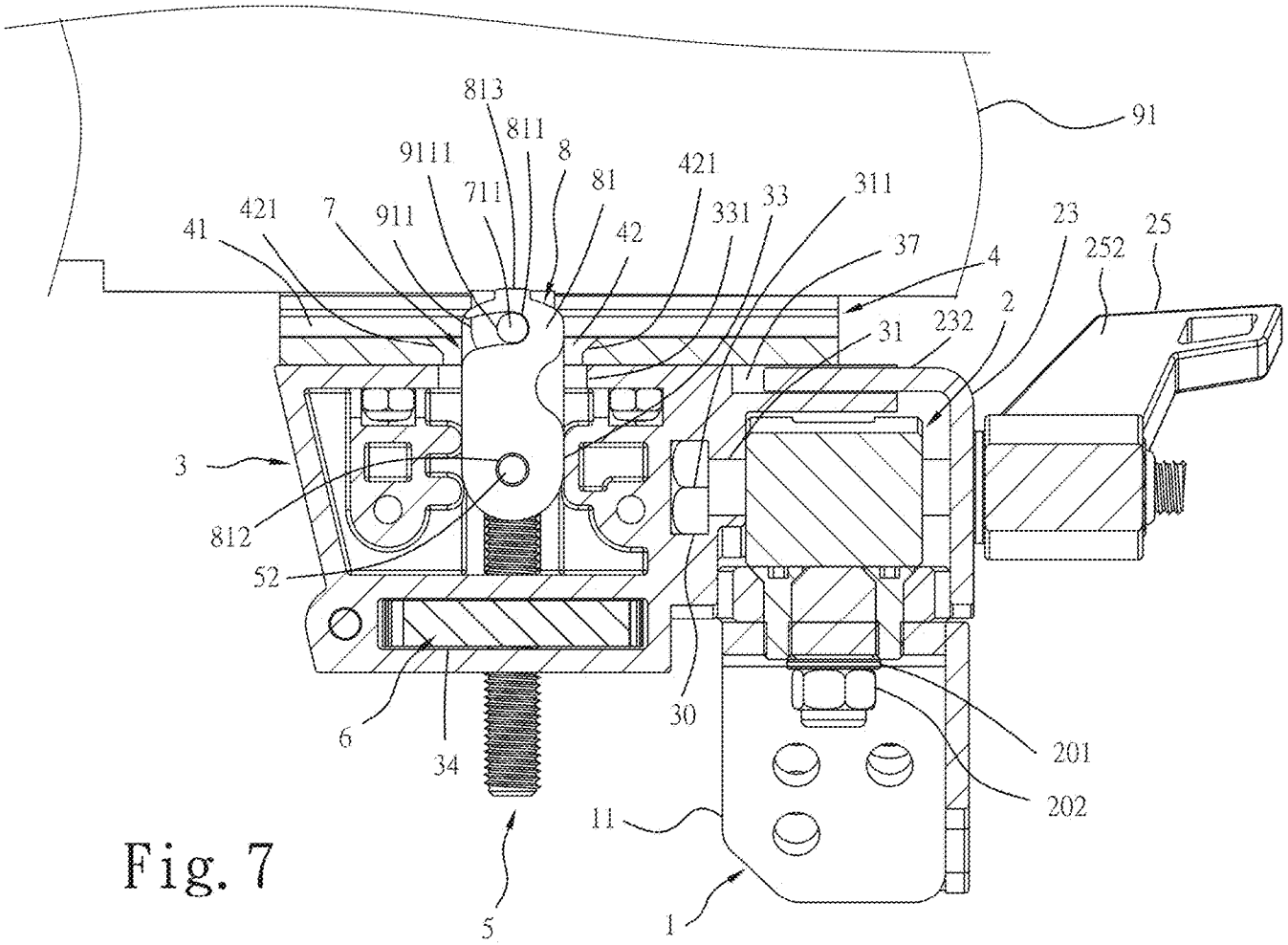
FIG. 7 is similar to FIG. 6, illustrating the arched positioning notch of the female swivel stud clamp hooked on the pin of the male swivel stud clamp.
Figure 8:
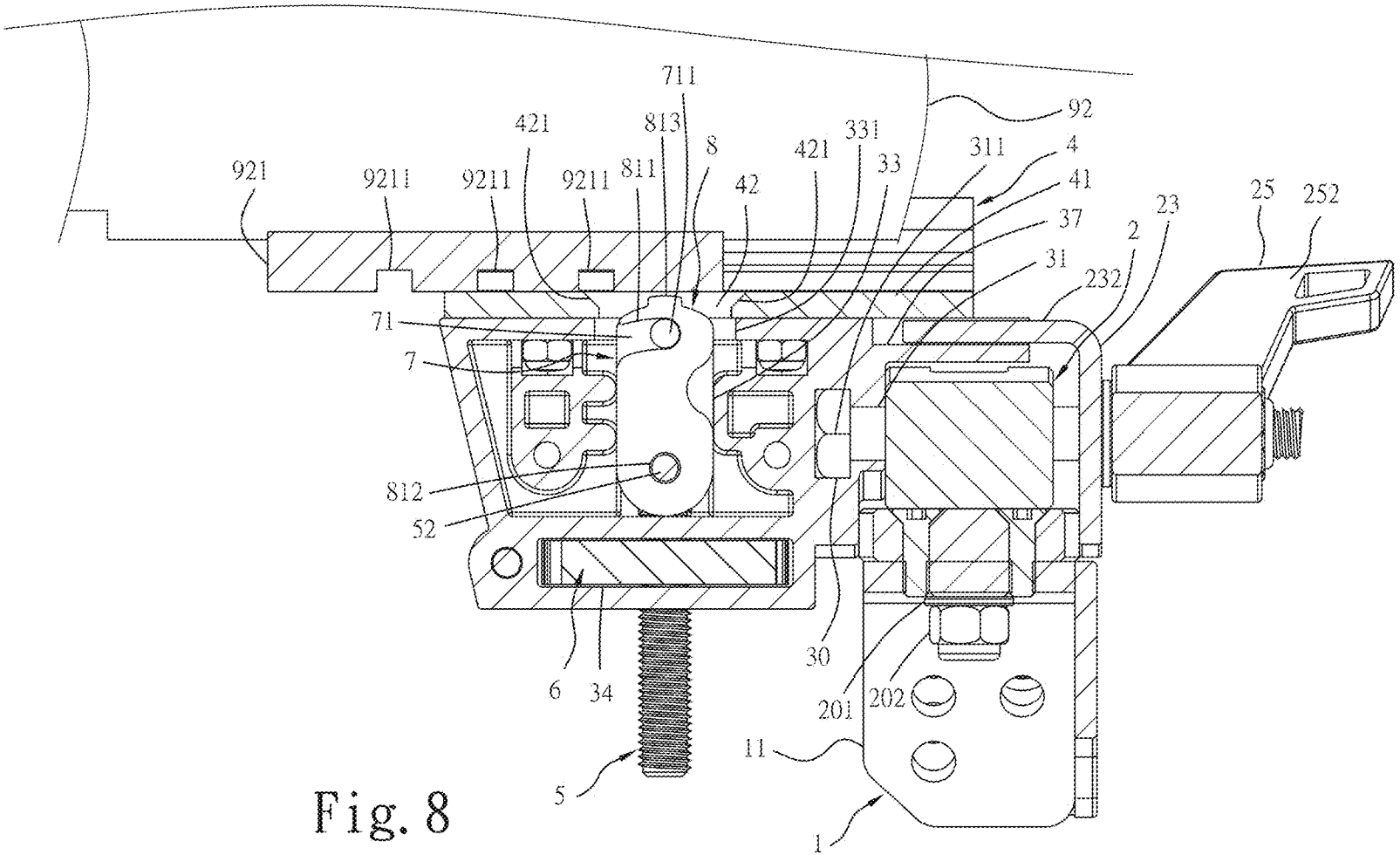
FIG. 8 is a schematic sectional view illustrating the lift control screw lowered and a rail of a gun inserted into the saddle base.
Figure 9:
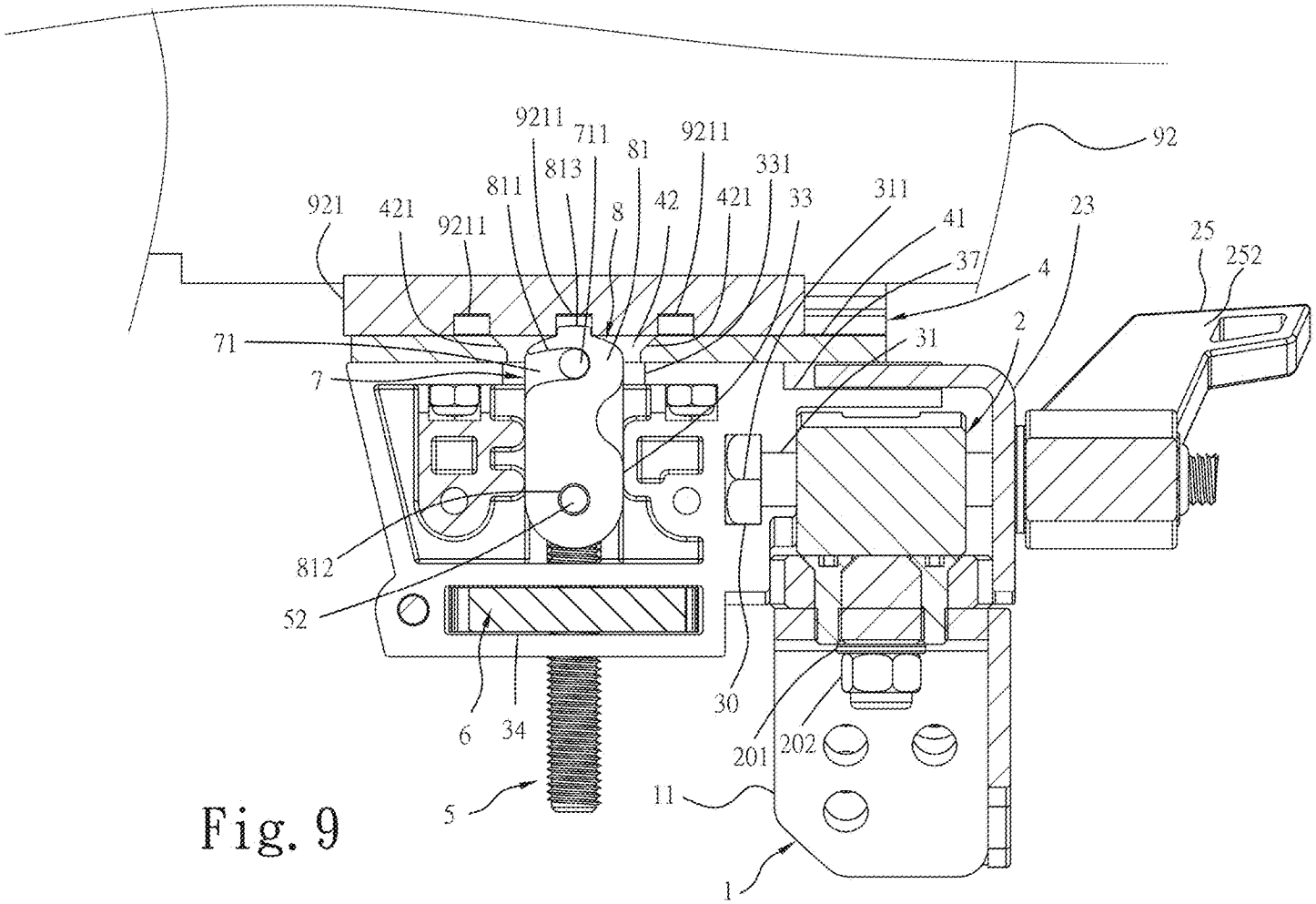
FIG. 9 corresponds to FIG. 8, illustrating the first engagement block of the male swivel stud clamp and the second engagement block of the female swivel stud clamp engaged into one retaining groove of the rail of the gun.

When the bipod dual-mount attachment structure is used to secure and support a gun 91 that is equipped with a swivel stud 911 (see FIGS. 6 and 7), rotate the adjustment knob 6 clockwise to lift the lift control screw 5 and the connected male swivel stud clamp 7 and female swivel stud clamp 8 away from the internal constraint hole 33, causing the male swivel stud clamp 7 and female swivel stud clamp 8 to be guided by the guide surfaces 421 of the guide groove 42 of the saddle base 4 and biased in direction away from the center of the attachment base 3 to an extended state (see FIG. 6). At this time, plug the pin 711 of the male swivel stud clamp 7 into a belt hole 9111 of the swivel stud 911 of the gun 91 (see FIG. 6), and then bias the female swivel stud clamp 8 to hook the arched positioning notch 811 on the pin 711 of the male swivel stud clamp 7 (see FIG. 7), thus, the connection between the bipod and the gun 91 is done. When the bipod dual-mount attachment structure is used to secure and support a gun 92 that is equipped with a rail 921, rotate the adjustment knob 6 counter-clockwise to lower the lift control screw 5 and the connected male swivel stud clamp 7 and female swivel stud clamp 8, causing the male swivel stud clamp 7 and the female swivel stud clamp 8 to be gradually constrained by the internal constraint hole 33 and biased toward the center of attachment base 3 till that the pin 711 of the male swivel stud clamp 7 is received in the arched positioning notch 811 of the female swivel stud clamp 8 and the first engagement block 713 of the male swivel stud clamp 7 and the second engagement block 813 of the female swivel stud clamp 8 are stopped at the top side of the guide groove 42 of the saddle base 4. At this time, insert the rail 921 of the gun 92 into the transverse sliding groove 41 of the saddle base 4 (see FIG. 8), then rotate the adjustment knob 6 clockwise to lift the lift control screw 5 and the connected male swivel stud clamp 7 and female swivel stud clamp 8, causing the first engagement block 713 of the male swivel stud clamp 7 and the second engagement block 813 of the female swivel stud clamp 8 to be engaged into one retaining groove 9211 at the bottom side of the rail 921 (see FIG. 9; in FIG. 9, the first engagement block 713 is shielded by the second engagement block 813). Thus, the connection between the bipod and the gun 92 is done.

After insertion of the pivot shaft 31 through the transverse axle hole 21 to pivotally connect the attachment base 3 to the axle housing 2, the pivot shaft 31 is inserted through a through hole 231 of a packing member 23 (see FIGS. 4 and 5) and a gasket 26 and then screwed up with a second nut 24, causing the packing member 23 to hold down the axle housing 2 on the top side 13 of the leg attachment base 1 (see FIG. 5), and thus, the axle housing 2 is stopped from rotation relative to the leg attachment base 1. On the contrary, when loosened the second nut 24, the packing member 23 is released from the axle housing 2, allowing rotation of the axle housing 2 relative to the leg attachment base 1 to the desired angle. The packing member 23 further comprises a top panel 8 (see FIGS. 2 and 5) slidable into or out of the slideway 37 of the attachment base 3 (see FIG. 5).

To facilitate operation, the invention provides a tool 25. The tool 25 comprises a non-circular coupling hole 251 located in one side thereof and attached onto the second nut 24 (see FIGS. 4 and 5), and a handle 252 located at an opposite side thereof. After the non-circular coupling hole 251 is attached onto the second nut 24, the user can operate the handle 252 to rotate the second nut 24 conveniently with less effort.

Further, the attachment base 3 is connected with an ornamental cover 39 using second fastening members 38.

In summary, the user can rotate the adjustment knob 6 to move the lift control screw 5 upward or downward in extending out or receiving the male and female swivel stud clamps 7,8 for securing a gun 91 that is equipped with a swivel stud 911 or a gun 92 that is equipped with a rail 921, achieving dual use.

What is claimed is:

1. A bipod dual-mount attachment structure, comprising:

a leg attachment base comprising two connection portions symmetrically disposed at two opposite lateral sides thereof for the connection of a respective leg in a pivotable manner and a first pivot connection hole located in the center;

an axle housing comprising a second pivot connection hole cut through opposing top and bottom sides thereof and pivotally connected to said first pivot connection hole of said leg attachment base with a first pivot bolt, a gasket and a first nut for allowing rotation of said axle housing relative to said leg attachment base, and a transverse axle hole cut through opposing front and rear sides thereof;

an attachment base comprising a locating groove located at one side thereof for the positioning of one end of a pivot shaft, a slideway, a top hole, an internal constraint hole disposed below and in communication with said top hole, a lower accommodation chamber spaced below said internal constraint hole, an upper through hole cut through a top partition wall of said lower accommodation chamber and a bottom through hole cut through an opposing bottom partition wall of said lower accommodation chamber;

a pivot shaft pivotally connecting said attachment base to said transverse axle hole of said axle housing, having one end thereof positioned in said locating groove of said attachment base;

a saddle base affixed to the top side of said attachment base with first fastening members, said saddle base comprising a transverse sliding groove, a guide groove disposed in communication with said transverse sliding groove with a bottom end thereof aimed at said top hole of said attachment base and defining two opposing guide surfaces;

a lift control screw comprising a first pivot rod and a second pivot rod transversely aligned in a line near a top end thereof and a threaded shank inserted in proper order through said top hole, said internal constraint hole, said upper through hole and said bottom through hole of said attachment base;

an adjustment knob mounted in said lower accommodation chamber of said attachment base, said adjustment knob comprising a center screw hole threaded onto said threaded shank of said lift control screw;

a male swivel stud clamp comprising a male clamp base plate, a pin perpendicularly formed integral with a top side of said male clamp base plate, a first pivot hole located at an opposing bottom side of said male clamp base plate and pivotally coupled to said first pivot rod of said lift control screw and a first engagement block protruded from the top side of said male clamp base plate; and a female swivel stud clamp comprising a female clamp base plate, an arched positioning notch located at a top side of said female clamp base plate, a second pivot hole located at an opposing bottom side of said female clamp base plate and pivotally coupled to said second pivot rod of said lift control screw and a second engagement block protruded from the top side of said female clamp base plate.

2. The bipod dual-mount attachment structure as claimed in claim 1, further comprising a packing member detachably attachable to said axle housing and having a through hole for the passing of said pivot shaft, a gasket mounted on said pivot shaft and disposed at one side of said packing member opposite to said axle housing, and a second nut threaded onto said pivot shaft to fasten up said packing member and said axle housing, holding down said axle housing on the top side of said leg attachment base.

3. The bipod dual-mount attachment structure as claimed in claim 2, wherein said packing member comprises a top panel slidable into and out of said slideway of said attachment base.

* * * * *